United States Patent [19]

Rohringer

[11] Patent Number: 5,064,570

[45] Date of Patent: Nov. 12, 1991

[54] DISPERSION FLUORESCENT BRIGHTENER PREPARATIONS

[75] Inventor: Peter Rohringer, Schönenbuch, Switzerland

[73] Assignee: Ciba-Geigy Corporation, Ardsley, N.Y.

[21] Appl. No.: 469,704

[22] Filed: Jan. 24, 1990

Related U.S. Application Data

[63] Continuation of Ser. No. 233,381, Aug. 17, 1988, abandoned.

[30] Foreign Application Priority Data

Aug. 26, 1987 [CH] Switzerland ..... 3263/87

[51] Int. Cl.[5] ..... C09K 11/06

[52] U.S. Cl. ..... 252/301.21; 8/648

[58] Field of Search ..... 252/301.21; 8/648

[56] References Cited

U.S. PATENT DOCUMENTS

| | | | |
|---|---|---|---|
| 3,475,172 | 10/1969 | Bright et al. | 430/139 |
| 4,042,320 | 8/1977 | Becker et al. | 252/301.21 |
| 4,058,480 | 11/1977 | Lohmann et al. | 252/301.21 |
| 4,094,634 | 6/1978 | Becker et al. | 252/301.21 |
| 4,341,565 | 7/1982 | Mortenson | 106/307 |
| 4,413,998 | 11/1988 | Guth et al. | 252/301.21 |
| 4,460,374 | 7/1984 | Abel et al. | 252/301.21 |
| 4,478,598 | 10/1984 | Meyer et al. | 252/301.21 |
| 4,559,150 | 12/1985 | Becker et al. | 252/301.21 |

OTHER PUBLICATIONS

Alpegiani et al., Heterocycles, vol. 27, No. 6 (1988).

Capraro et al., Abstract No. 224, Programs and Abstracts of 28th Interscience Conference on Antimicrobial and Chemotherapy (ICAAC), 1988.

Capraro et al., Poster Presented at the 28th ICAAC (10/88).

*Primary Examiner*—John Niebling

*Assistant Examiner*—Steven P. Marquis

*Attorney, Agent, or Firm*—George R. Dohmann; Edward McC. Roberts

[57] ABSTRACT

Dispersion fluorescent brightener preparations which contain specific water-insoluble aromatic or $C_{14}$–$C_{18}$ fatty alcohol auxiliaries which have melting points between above 40° C. and 200° C. are described. The preparations are used for fluorescent brightening of coating compositions for coating paper, cardboard, wood, films, textile materials, non-woven materials and building materials.

16 Claims, No Drawings

DISPERSION FLUORESCENT BRIGHTENER PREPARATIONS

This application is a continuation of application Ser. No. 233,381, filed 8/17/88, now abandoned.

The present invention relates to novel solid and liquid dispersion fluorescent brightener preparations, their preparation and their use for fluorescent brightening of coating compositions, for example for coating paper, cardboard, wood, films, textile materials, non-woven materials and building materials.

It is known that coating compositions for coating smooth surfaces can be given a fluorescent brightening effect by means of anionic compounds from the triazinylflavonic acid series. However, this class of substance gives good degrees of whiteness only in coating compositions containing natural binders, such as casein, starch, protein or gelatin.

For the coating compositions customary today, which predominantly contain synthetic latex binders based on, for example, copolymers of styrene/butadiene/acrylic acid esters or styrene/butyl acrylate, it has therefore been proposed to use dispersion brighteners in the presence of dispersing agents and if appropriate non-ionic emulsifiers (British Patent 1,294,173 and British Patent 1,349,934). A disadvantage of this process is the low maximum possible degree of whiteness and the marked dependence of the degree of whiteness on the drying temperature.

Other proposals for a solution comprise improving the fluorescent brightening effects by incorporation of organic solvents (DE-A-2,242,597) and additional solubilizing agents (DE-A-2,806,195). However, these formulations can be used to only a limited degree in practice, since explosive air mixtures can form on evaporation of the solvents and the solvent vapors can lead to health hazards in the factory and to pollution of the environment.

It has now been found that preparations which, in addition to at least one dispersion fluorescent brightener and at least one dispersing agent and/or emulsifier, if appropriate other additives and water, also contain at least one specific water-insoluble aromatic or $C_{14}$–$C_{18}$ fatty alcohol auxiliary or auxiliary mixture which has a melting point between above 40° C. and 200° C., preferably up to 120° C., surprisingly do not show these disadvantages.

Cetyl alcohol and in particular compounds of the formula

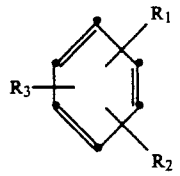

(I)

in which $R_1$ is —COOR, —COR, $SO_2NHR$, R or OH, $R_2$ is H, —COOR, —COR, $SO_2NHR$ or R, and $R_3$ is H or phenylene, where R is $C_1$–$C_8$alkyl, $C_3$–$C_8$cycloalkyl or phenyl, each of which is unsubstituted or substituted by $C_1$–$C_8$alkyl, $C_3$–$C_8$cycloalkyl or phenyl, are used as such auxiliaries.

These are, for example, the following compounds: benzyl phenyl ketone, phenyl salicylate, benzophenone, dibenzyl, p-benzylbiphenyl, benzenesulfanilide, 1-hydroxy-2-phenyl-naphthoate, diphenyl terephthalate, dimethyl terephthalate and/or dicyclohexyl phthalate (DCHP).

These auxiliaries are used in amounts of 0.1 to 150 parts, in particular in amounts of 1 to 100 parts and especially in amounts of 9 to 100 parts, per part of dispersion fluorescent brightener.

Water-insoluble fluorescent brighteners or fluorescent brighteners which are sparingly soluble in water, for example those described in DE-A-2,806,195, but preferably dispersion fluorescent brighteners from the class of coumarins and/or benzoxazoles, in particular benzoxazolylthiophenes, are used as the dispersion fluorescent brighteners. The dispersion fluorescent brighteners are known. The fluorescent brighteners and mixtures of fluorescent brighteners of the formula

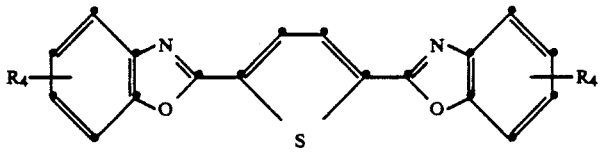

(II)

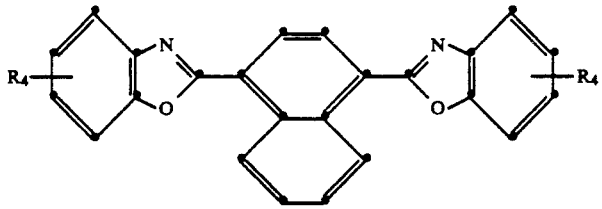

(III)

-continued (IV)

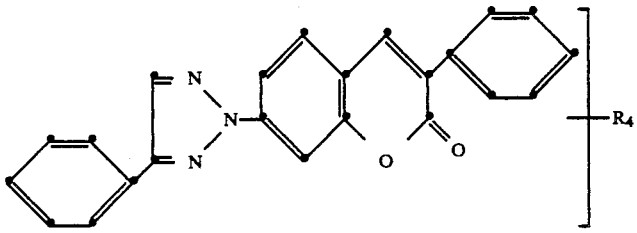

(V)

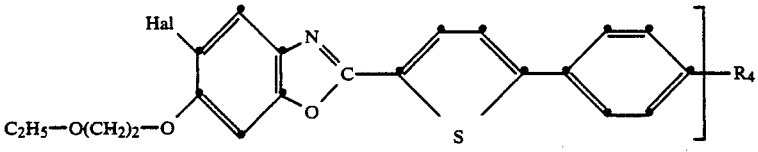

and (VI)

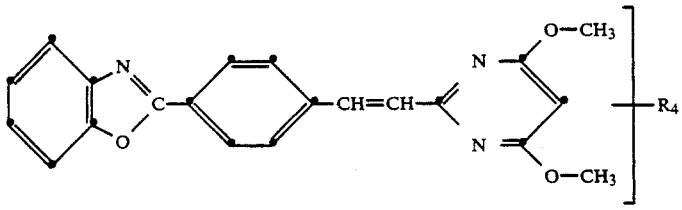

in which the radicals $R_4$ are hydrogen or independently of one another $C_1$–$C_6$alkyl, are of particular interest.

The preparation according to the invention contains customary anionic or cationic and/or non-ionic emulsifiers and/or dispersing agents as the dispersing agents and/or emulsifiers, preferably in amounts of 2–20%, in particular 5–10%, based on the sum of dispersion fluorescent brightener and auxiliary.

Examples which may be mentioned of anionic emulsifiers are: carboxylic acids and their salts, such as the sodium, potassium or ammonium salts of lauric, stearic or oleic acid, acylation products of aminocarboxylic acids and their salts, for example the sodium salt of oleoylsarcoside, sulfates, such as fatty alcohol sulfates, for example lauryl sulfate and lorol sulfate, sulfates of hydroxy fatty acid esters, for example sulfated castor oil, and of fatty acid hydroxyalkylamides, for example sulfated coconut oil acid ethanolamide, and sulfates of partially esterified or etherified polyhydroxy compounds, such as sulfated oleic acid monoglyceride or glycerol ether-sulfates, and furthermore sulfates of substituted polyglycol ethers, for example nonylphenol polyglycol ethersulfate, sulfonates, such as primary and secondary alkylsulfonates, for example $C_{12}$–$C_{16}$paraffinsulfonic acids and sodium salts thereof, alkylsulfonates with acyl radicals bonded in amide of ester form, such as oleyl-methyl-tauride, and sulfonates of polycarboxylic acid esters, such as di-iso-octyl-sulfatosuccinic acid esters; and furthermore those with aromatic groups such as alkylbenzene, for example dodecylbenzene-, alkylnaphthalene-, such as dibutylnaphthalene- and alkylbenzimidazole-, such as tetradecylbenzimidazole-sulfonates.

Examples of non-ionic emulsifiers which may be mentioned are:

Esters and ethers of polyalcohols, such as alkyl polyglycol ethers, for example lauryl alcohol or oleyl alcohol, polyethylene glycol ethers, acyl polyglycol ethers, such as oleic acid polyglycol ether, alkylaryl polyglycol ethers, such as the ethoxylation products of nonyl- and do-decylphenol, acylated amino-alkanol polyglycol ethers, and furthermore the known non-ionic surfactants which are derived from fatty amines, such as stearylamine, fatty acid amides or sugars and derivatives thereof.

The anionic dispersing agents are the customary dispersing agents, for example condensation products of aromatic sulfonic acids with formaldehyde or ligninsulfonates, for example the compounds obtainable under the description of sulfite waste liquor. However, naphthalenesulfonic acid/ formaldehyde condensation products are particularly suitable. Mixtures of these dispersing agents can also be used.

Non-ionic dispersing agents which may be mentioned are the ethylene oxide adducts of the class of addition products of ethylene oxide on higher fatty acids, saturated or unsaturated fatty alcohols, mercaptans, fatty acid amides, fatty acid alkylolamides or fatty amines or alkylphenols or alkylthiophenols having at least 7 carbon atoms in the alkyl radical, and furthermore ricinoleic acid esters or hydroxyabietyl alcohol. Some of the ethylene oxide units can be replaced by other epoxides, for example styrene oxide or, in particular, propylene oxide.

Ethylene oxide adducts which may be mentioned specifically are:

a) reaction products of saturated and/or unsaturated fatty alcohols having 8 to 20 C atoms with 20 to 100 mol of ethylene oxide per mol of alcohol;
b) reaction products of alkylphenols having 7 to 12 C atoms in the alkyl radical with 5 to 20 mol, preferably 8 to 15 mol, of ethylene oxide per mol of phenolic hydroxyl group;
c) reaction products of saturated and/or unsaturated fatty amines having 8 to 20 C atoms with 5 to 20 mol of ethylene oxide per mol of amine;

reaction products of saturated and/or unsaturated fatty acids having 8 to 20 C atoms with 5 to 20 mol of ethylene oxide per mol of fatty acid;

e) a reaction product of 1 mol of ricinoleic acid ester and 15 mol of ethylene oxide;

f) a reaction product of 1 mol of hydroxyabietyl alcohol and 25 mol of ethylene oxide.

Mixtures of the ethylene oxide adducts according to a) to f) with one another can also be used. These mixtures are obtained by mixing individual reaction products or directly by ethoxylation of a mixture of the compounds on which the adducts are based. An ethoxylated nonylphenol is preferably used.

Possible cationic dispersing agents are, for example, quaternary fatty amine polyglycol ethers.

The preparation can in addition also contain 45–95% of water and preservatives and foam suppressants. However, the solid preparations are preferred.

The preparations according to the invention are obtained by simple mixing or dry grinding of the components, or by melting the dispersion fluorescent brightener and the auxiliary together, if appropriate in the presence of dispersing agents and/or emulsifiers, allowing the melt to solidify and then subjecting it to dry grinding or if appropriate wet grinding, if appropriate in the presence of dispersing agents and/or emulsifiers.

The preparations according to the invention are suitable for fluorescent brightening of the coating compositions usually employed in the paper industry, and in particular for fluorescent brightening of non-pigmented, but especially pigmented, coating compositions. These known coating compositions contain as binders, inter alia, plastics dispersions based on copolymers of butadiene/styrene, acrylonitrile/butadiene/styrene, acrylic acid esters, ethylene/vinyl chloride and ethylene/vinyl acetate; or homopolymers, such as polyvinyl chloride, polyvinylidene chloride, polyethylene and polyvinyl acetate or polyurethanes. A preferred binder consists of styrene/butyl acrylate or styrene/-butadiene/acrylic acid copolymers. Other polymer latices are described, for example, in U.S. Pat. Nos. 3,265,654, 3,657,174, 3,547,899 and 3,240,740. The preparation according to the invention is incorporated into these binders, for example, by means of melt emulsification.

Aluminium silicates, such as China clay and kaolin, and furthermore barium sulfate, satin white, titanium dioxide or calcium carbonate (chalk) are usually employed for pigmenting the coating compositions.

Recipes of such known coating compositions for paper are described, for example, in J. P. Casey "Pulp and Paper"; Chemistry and Chemical Technology, 2nd edition, Volume III, pages 1648–1649 and in McGraw-Hill "Pulp and Paper Manufacture", 2nd and 5th edition, Volume II, page 497.

The coating compositions according to the invention preferably contain 30 to 70% by weight of a white pigment. The binder is preferably used in an amount which is sufficient to make the dry content of polymeric compound up to 1 to 30 per cent by weight, preferably 5 to 25 per cent by weight, of the white pigment. The amount of fluorescent brightener preparation according to the invention is calculated so that the dispersion fluorescent brightener is present in amounts of 0.001 to 1 per cent by weight, in particular 0.01 to 0.55 per cent by weight, based on the white pigment.

The coating composition according to the invention can be prepared by mixing the components in any desired sequence at temperatures of 10° to 100° C., preferably 20° to 80° C. The components here also include the customary auxiliaries which can be added to regulate the rheological properties, such as viscosity or water retention capacity, of the coating compositions. Such auxiliaries are, for example, natural binders, such as starch, casein, protein or gelatin, cellulose ethers, such as carboxyalkylcellulose or hydroxyalkylcellulose, alginic acid, alginates, polyethylene oxide or polyethylene oxide alkyl ethers, copolymers of ethylene oxide and propylene oxide, polyvinyl alcohol, polyvinylpyrrolidone, water-soluble condensation products of formaldehyde with urea or melamine, polyphosphates or polyacrylic acid salts.

The coating composition according to the invention can be used for coating paper, wood, films, for example polypropylene, polyethylene, polyester, cellulose or cellulose triacetate, textile materials, non-woven materials and suitable building materials, for example wallpaper, room linings and plastic coverings. Use on paper, cardboard and photographic papers is particularly preferred.

The coating composition can be applied to the substrate by any conventional process, for example with an air blade, a coating blade, a brush, a roller, a doctor blade or a rod, after which the coating is dried at paper surface temperatures in the range from 70° to 200° C., preferably 90 to 130° C., to a residual moisture content of 3–6%, for example with infra-red driers and/or hot-air driers. Comparably high degrees of whiteness are thus already achieved at low drying temperatures.

By the use of the preparations or auxiliaries according to the invention, the coatings obtained are distinguished by optimum distribution of the dispersion fluorescent brightener over the entire surface and an increase in the level of whiteness thereby achieved and a high fastness to light.

The invention is illustrated in more detail by the following examples, in which all the parts and percentages are expressed in weight, unless indicated otherwise.

EXAMPLE 1

The fluorescent brightener of the formula

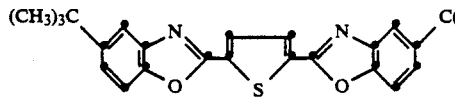

(1)

is mixed with the parts of the components stated in Table 1 in a glass bead stirring mill (glass bead diameter of 2 mm) in the presence of water at room temperature for 15 hours.

EXAMPLE 2

The fluorescent brightener according to Example 1 is melted together with the components and parts shown in Table 2 and, after cooling, the solid is ground in the dry state and then dispersed in water in accordance with Example 1.

TABLE 1

| Preparation No. | Parts of auxiliary | Parts of fluoroescent brightener according to Example 1 | Naphthalenesulfonic acid/formaldehyde | Nonylphenol (35 EO) |
|---|---|---|---|---|
| 1.1 | 90 DCHP | 10 | 5% | |
| 1.2 | 90 DCHP | 10 | 10% | |
| 1.3 | 90 DCHP | 10 | | 10% |
| 1.4 | 85 DCHP | 15 | 10% | |
| 1.5 | 90 Benzophenone | 10 | 10% | |
| 1.6 | 90 Dibenzyl | 10 | 10% | |
| 1.7 | 90 Benzyl phenyl ketone | 10 | 10% | |

The homogeneous dispersions obtained are pourable and stable on storage. The percentage data in Table 1 relate to the sum of the dry substance of the fluorescent brightener and auxiliary.

TABLE 2

| Preparation No. | Parts of auxiliary | Parts of fluorescent brightener | Naphthalenesulfonic acid/formaldehyde | Nonylphenol (35 EO) |
|---|---|---|---|---|
| 2.1 | 90 DCHP | 10 | 5% | |
| 2.2 | 90 DCHP | 10 | 10% | |
| 2.3 | 90 DCHP | 10 | | 5% |
| 2.4 | 90 DCHP | 10 | | 10% |
| 2.5 | 85 DCHP | 15 | 10% | |
| 2.6 | 80 DCHP | 20 | 10% | |
| 2.7 | 90 Benzophenone | 10 | 10% | |

The homogeneous dispersions obtained are pourable and stable on storage. The percentage data in Table 2 relate to the sum of the dry substance of the fluorescent brightener and auxiliary.

EXAMPLE 3 a) Preparation of the coating composition 700 g of a commercially available kaolin pigment and 300 g of a commercially available calcium carbonate pigment are dispersed with 385 g of water and 5 g of a dispersing agent based on the Na salt of a polycarboxylic acid at a pH of about 9 under the action of strong shearing forces. 240 g of a commercially available 50% strength polymer dispersion based on a styrene/butyl acrylate copolymer (Acronal S 320 D from BASF) and one of the fluorescent brightener dispersions described in Examples 1 and 2 are added to the resulting pigment dispersion, and the mixture is stirred. The amount of fluorescent brightener used is 0.3%, based on the amount of pigment used. The coating composition is then brought to a solids content of 50% by dilution with water.

b) Application of the coating on paper

The coating is applied with the aid of a hand doctor blade to wood-free coated base paper which has been sized with acid in the customary manner, so that the coating weight after drying with the aid of an IR irradiator is about 15 g per $m^2$. The residual moisture still present after this drying is about 2%.

c) Determination of the degree of whiteness

The whiteness of the coating is determined in accordance with "CibaGeigy-Weissgrad (Ciba-Geigy degree of whiteness)", as described in "Stand der instrumentellen Weissbewertung unter besonderer Berücksichtigung der Beleuchtung (Status of instrumental evaluation of whiteness taking into particular account the illumination)", Textilveredlung 5/1983, pages 157–162. The degree of whiteness of preparations 1.1 to 2.7 is given in Table 3.

TABLE 3

| Example | Preparation No. | Ciba-Geigy degree of whiteness |
|---|---|---|
| 1 | 1.1 | 116,0 |
| | 1.2 | 118,0 |
| | 1.3 | 109,0 |
| | 1.4 | 101,2 |
| | 1.5 | 68,5 |
| | 1.6 | 92,3 |
| | 1.7 | 109,1 |
| 2 | 2.1 | 127,5 |
| | 2.2 | 124,6 |
| | 2.3 | 112,8 |
| | 2.4 | 112,0 |
| | 2.5 | 111,1 |
| | 2.6 | 103,7 |
| | 2.7 | 96,8 |

EXAMPLE 4

A coating composition is prepared without an auxiliary, but with 0.3% of the fluorescent brightener according to Example 1 and the dispersing agents mentioned in Table 4 and is applied, by the procedure analogous to that in Example 3 (preparations 4.1 to 4.4). The results of the measurement of the degree of whiteness are compared with those of corresponding preparations of Example 2 in Table 4.

TABLE 4

| Preparation No. | Naphthalenesulfonic acid/formaldehyde (in %, based on the fluorescent brightener) | Nonylphenyl (35 EO) | Ciba-Geigy degree of whiteness | | Preparation No. |
|---|---|---|---|---|---|
| 4.1 | 5% | | 62,2 | 127,5 | 2.1 |
| 4.2 | 10% | | 59,5 | 124,6 | 2.2 |
| 4.3 | | 5% | 75,3 | 112,8 | 2.3 |
| 4.4 | | 10% | 73,7 | 112,0 | 2.4 |

EXAMPLE 5 a) The fluorescent brightener of the formula (1) is melted together with the components and parts shown in Table 5 and, after cooling, the solid is subjected to dry grinding.

b) The solid pulverulent preparation thus obtained is introduced into a hot solution, at 90° C., of 9% aqueous polyvinyl alcohol (Mowiol 4-98 from Hoechst) and is subjected to melt emulsification by applying shearing forces. An amount of this aqueous formulation is then stirred with the pigment dispersion according to Example 3a) so that the coating composition formed contains 0.4% of polyvinyl alcohol, based on the amount of pigment. The amount of fluorescent brightener used is 0.3% or 0.1%, based on the amount of pigment used.

The coating composition thus obtained is brought to a solids content of 50% by dilution with water and is applied in accordance with Example 3b), and the degree of whiteness is determined in accordance with Example 3c). The degrees of whiteness can be seen from Table 5.

TABLE 5

| Preparation No. | Parts of auxiliary | Parts of fluorescent brightener | Emulsifier[2] 100% dry content | Whiteness with an amount of 0.3% of fluorescent brightener[1] |
|---|---|---|---|---|
| 5.0 | none | none | none | 41 |
| 5.1 | 100 DCHP | 1 | 5% emulsifier[3] | 151 |
| 5.2 | 100 | 2 | 5% emulsifier[3] | 138 |
| 5.3 | 100 | 10 | 5% emulsifier[3] | 112 |
| 5.4 | 100 | 20 | 5% emulsifier[3] | 91 |
| 5.5 | 100 | 100 | 5% emulsifier[3] | 63 |

TABLE 5-continued

| Preparation No. | Parts of auxiliary | Parts of fluorescent brightener | Emulsifier[2] 100% dry content | Whiteness with an amount of 0.3% of fluorescent brightener[1] |
|---|---|---|---|---|
| 5.6 | 100 Benzophenone | 1 | 5% emulsifier[3] | 124 |
| 5.7 | 100 | 2 | 5% emulsifier[3] | 127 |
| 5.8 | 100 | 10 | 5% emulsifier[3] | 106 |
| 5.9 | 100 | 20 | 5% emulsifier[3] | 93 |
| 5.10 | 100 | 100 | 5% emulsifier[3] | 65 |
| 5.11 | 100 Cetyl alcohol | 1 | 5% emulsifier[3] | 144 |
| 5.12 | 100 | 2 | 5% emulsifier[3] | 146 |
| 5.13 | 100 | 10 | 5% emulsifier[3] | 95 |
| 5.14 | 100 Phenyl salicylate | 1 | 5% emulsifier[3] | 139 |
| 5.15 | 100 | 2 | 5% emulsifier[3] | 117 |
| 5.16 | 100 | 10 | 5% emulsifier[3] | 72 |
| 5.17 | 100 DCHP | 10 | 5% emulsifier[4] | 101 |
| 5.18 | 100 | 10 | 5% emulsifier[5] | 113 |
| 5.19 | 100 | 10 | 5% emulsifier[6] | 85 |

[1]based on the amount of pigment used
[2]based on the sum of dry substance of fluorescent brighteners and auxiliary
[3]ethoxylated hydroxyabietyl alcohol with 200 mol of ethylene oxide (EO) + 1% of hexamethylene 1,6-diisocyanate

EXAMPLE 6

Solid preparations are prepared with in each case a fluorescent brightener of the formula

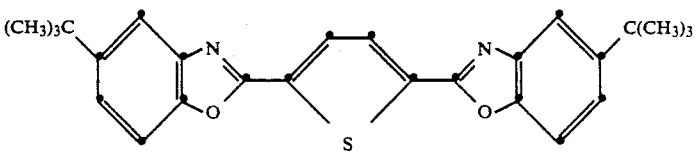

(1)

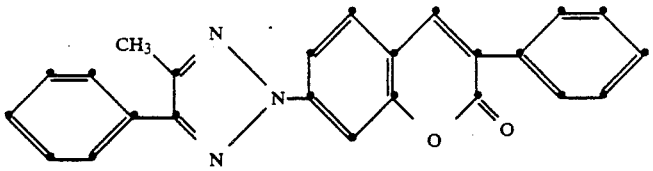

(2)

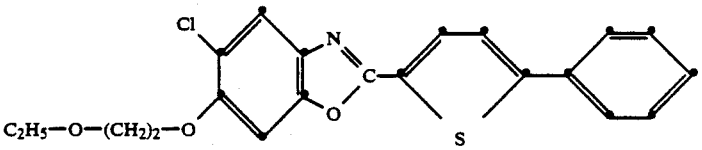

(3)

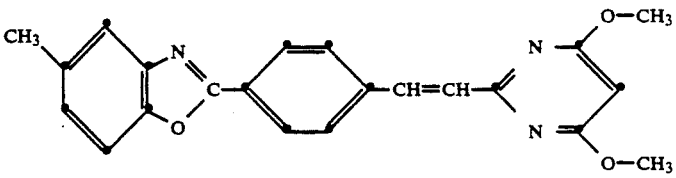

(4)

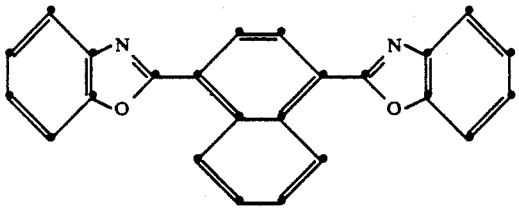

(5)

-continued (6)

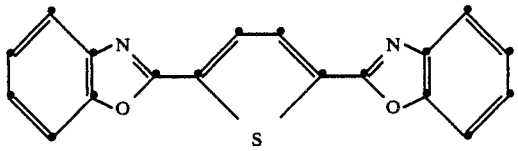

and the components and parts shown in Table 6 are prepared in accordance with Example 5a. These preparations are further processed in accordance with Example 5b). The degrees of whiteness can be seen from Table 6.

TABLE 6

| Preparation No. | Parts of auxiliary | Parts of fluorescent whitener | Emulsifier[2] 100% dry content 100% | CG degree of whiteness with an amount of 0.1% of fluorescent brightener[1] |
|---|---|---|---|---|
| 6.1 | 90 DCHP | 10 fluorescent (1) whitener | 5% emulsifier[3] | 96 |
| 6.2 | 90 DCHP | 10 fluorescent (2) whitener | 5% emulsifier[3] | 96 |
| 6.3 | 90 DCHP | 10 fluorescent (3) whitener | 5% emulsifier[3] | 85 |
| 6.4 | 90 DCHP | 10 fluorescent (4) whitener | 5% emulsifier[3] | 83 |
| 6.5 | 90 DCHP | 10 fluorescent (5) whitener | 5% emulsifier[3] | 96 |
| 6.6 | 90 DCHP | 5 fluorescent (1) whitener<br>5 fluorescent (6) whitener | 5% emulsifier[3] | 90 |
| 6.7 | 90 DCHP | 2,5 fluorescent (1) whitener<br>2,5 fluorescent (2) whitener<br>2,5 fluorescent (4) whitener<br>2,5 fluorescent (6) whitener | 5% emulsifier[3] | 96 |

[1]based on the amount of pigment used
[2]based on the sum of dry substance of fluorescent brighteners and auxiliary
[3]ethoxylated hydroxyabietyl alcohol with 200 mol of ethylene oxide (EO) + 1% of hexamethylene 1,6-diisocyanate

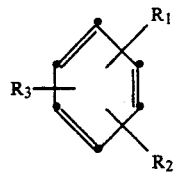

(I)

What is claimed is:

1. A dispersion fluorescent brightener preparation comprising:

(a) dispersion fluorescent brightener or a mixture of dispersion fluorescent brighteners;

(b) an agent for dispersing or emulsifying said fluorescent brightener or a mixture of said agents; and (c) an auxiliary consisting of a water-insoluble aromatic compound of $C_{14}$–$C_{18}$ fatty alcohol or mixtures thereof, said auxiliary having a melting point between 40° C. and 200° C.; with the proviso that said dispersion fluorescent brightener preparation is substantially free of volatile organic solvent water-soluble acids and organophilic, expanding-lattice clay ion exchanged with alkyl quaternary ammonium ions or hydrogen ions.

2. A preparation according to claim 1, which contains as the auxiliary a compound of the formula in which $R_1$ is —COOR, —COR, $SO_2NHR$, R or OH, $R_2$ is H, —COOR, —COR, $SO_2NHR$ or R, and $R_3$ is H or phenylene, where R is $C_1$–$C_8$alkyl, $C_3$–$C_8$cycloalkyl or phenyl, each of which is unsubstituted or substituted by $C_1$–$C_8$alkyl, $C_3$–$C_8$cycloalkyl or phenyl, are used as such auxiliaries.

3. A preparation according to claim 2, which contains an auxiliary selected from the group consisting of benzyl phenyl ketone, phenyl salicylate, benzophenone, dibenzyl, p-benzyl-biphenyl, benzene sulfanilide, 1hydroxy-2-phenyl-naphthoate, diphenyl terephthalate, dimethyl terephthalate, cetyl alcohol and dicyclohexyl phthalate, or mixtures thereof.

4. A preparation according to claim 1 containing 0.1–150 parts of the auxiliary or auxiliary mixture per part of dispersion fluorescent brightener and 2–20% of dispersing or emulsifying agent, based on the sum dispersion fluorescent brightener and auxiliary.

5. A preparation according to claim 4, which contains 1–100 parts of auxiliary per part of fluorescent brightener.

6. A preparation according to claim 1, which contins a dispersion fluorescent brightener from the class of coumarins or benzoxazoles or mixtures thereof.

7. A preparation according to claim 6, which contains as the dispersion fluorescent brightener a compound selected from the group consisting of

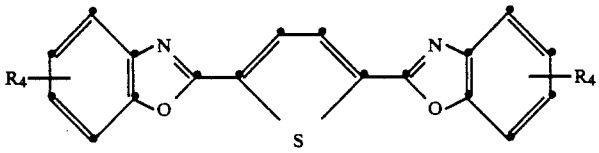

(II)

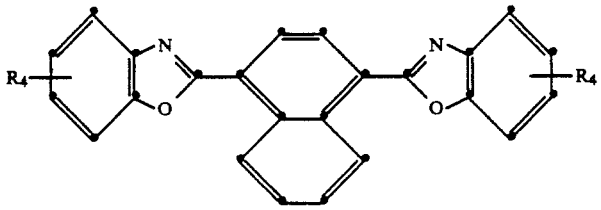

(III)

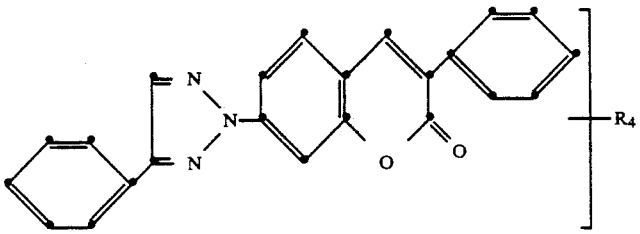

(IV)

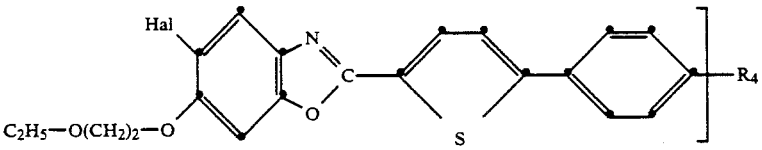

(V)

and

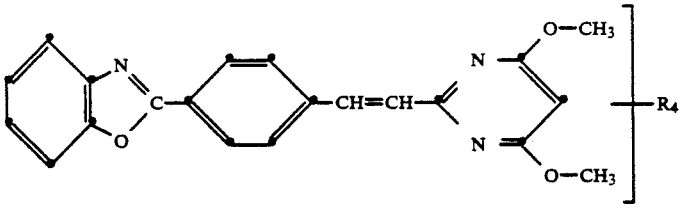

(VI)

in which the radicals $R_4$ are hydrogen or independently of one another $C_1$–$C_6$-alkyl or mixtures thereof.

8. A preparation according to claim 7, which contains as the auxiliary a compound selected from the group consisting of dicyclohexylphthalate.

9. A preparation according to claim 6, which contains as the dispersion fluorescent brightener a compound of the formula

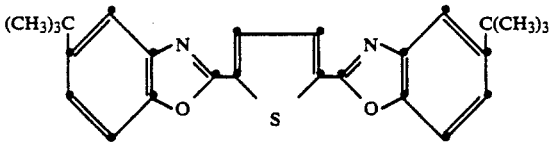

10. A preparation of claim 1 which further comprises 45–95% of water.

11. A dispersion fluorescent brightener preparation of claim 1 which is solid at room temperature.

12. A process for obtaining a dispersion fluorescent brightener preparation comprising:

(a) a dispersion fluorescent brightener or a mixture of dispersion fluorescent brighteners;

(b) an agent for dispersion or emulsifying said fluorescent brightener or a mixture of said agents; and (c) an auxiliary consisting of water-insoluble aromatic compound or $C_{14}$–$C_{18}$ fatty alcohol or mixtures thereof, said auxiliary having a melting point between 40° C. and 200° C.; with the proviso that said dispersion fluorescent brightener preparation is substantially free of volatile organic solvents, water-soluble acids and organophilic, expanding-lattice clay ion exchanged with alkyl quaternary ammonium ions or hydrogen ions;

which comprises the steps of:

(1) melting the dispersion fluorescent brightener and said auxiliary together;

(2) allowing the melt to solidify; and then (3) grinding the product;

said dispersing agent or emulsifying agent being melted and added simultaneously with the dispersion fluorescent brightener and auxiliary, or being added subsequently during the grinding step.

13. A method for fluorescent brightening or coating compositions for paper, photographic paper, cardboard, films, wood, non-woven materials and building materials which comprises adding to said coating composition a dispersion fluorescent brightener preparation comprising:

(a) a dispersion fluorescent brightener or a mixture of dispersion fluorescent brighteners;

(b) an agent for dispersing or emulsifying said fluorescent brightener or a mixture of said agents; and (c) an auxiliary consisting of a water-insoluble aromatic compound or $C_{14}$–$C_{18}$ fatty alcohol or mixtures thereof, said auxiliary having a melting point between 40° C. and 200° C.

14. A method according to claim 13 for fluorescent brightening of coating compositions for paper, photographic paper and cardboard.

15. An aqueous coating composition comprising:

(a) white pigments;

(b) synthetic binders;

(c) a dispersion fluorescent brightener or a mixture of dispersion fluorescent brighteners;

(d) an agent for dispersing or emulsifying said fluorescent brightener or a mixture of said agents; and (e) an auxiliary consisting of a water-insoluble aromatic compound or $C_{14}$–$C_{18}$ fatty alcohol or mixtures thereof, said auxiliary having a melting point between 40° C. and 200° C.; with the proviso that said coating composition is substantially free of volatile organic solvents, water-soluble acids and organophilic, expanding-lattice clay ion exchanged with alkyl quaternary ammonium ions or hydrogen ions.

16. A process for the preparation of an aqueous coating composition comprising:

(a) white pigments;

(b) synthetic binders;

(c) a dispersion fluorescent brightener or a mixture of dispersion fluorescent brighteners;

(d) an agent for dispersion or emulsifying said fluorescent brightener or a mixture of said agents; and (e) an auxiliary consisting of a water-insoluble aromatic compound or $C_{14}$–$C_{18}$ fatty alcohol or mixtures thereof, said auxiliary having a melting point between 40° C. and 200° C; with the proviso that said dispersion fluorescent brightener preparation is substantially free of volatile organic solvents, water-soluble acids organophilic, expanding lattice clay ion exchanged with alkyl quaternary ammonium ions or hydrogen ions;

which comprises the step of subjecting the components to mixing or melt emulsification in any sequence at temperatures from 10° C. to 150° C.

* * * * *